US006572330B2

(12) United States Patent
Burdgick

(10) Patent No.: US 6,572,330 B2
(45) Date of Patent: Jun. 3, 2003

(54) METHODS AND APPARATUS FOR PREFERENTIAL PLACEMENT OF TURBINE NOZZLES AND SHROUDS BASED ON INLET CONDITIONS

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 09/820,291

(22) Filed: Mar. 29, 2001

(65) Prior Publication Data

US 2002/0141864 A1 Oct. 3, 2002

(51) Int. Cl.[7] ..... F01D 9/04

(52) U.S. Cl. ..... 415/191; 29/889.22; 415/208.2; 415/115; 415/200

(58) Field of Search ..... 29/889.21, 889.22; 415/193, 191, 195, 208.2, 115, 200, 209.1; 416/203

(56) References Cited

U.S. PATENT DOCUMENTS 6,183,192 B1 * 2/2001 Tressler et al. ..... 415/115

* cited by examiner

*Primary Examiner*—Edward K. Look
*Assistant Examiner*—Kimya N McCoy
(74) *Attorney, Agent, or Firm*—Nixon & Vanderhye

(57) ABSTRACT

A gas turbine has circumferential arrays of nozzles and shrouds and a plurality of combustors for flowing hot gases of combustion through respective sets of adjacent nozzles and shrouds. First and second nozzles of each set of nozzles are subject to different known inlet conditions of the hot gases of combustion flowing from the associated combustor and transition piece. The first nozzle in each set is preferentially located relative to the second nozzle of that set at a circumferential location relative to the associated combustor based on the known different inlet conditions. The first and second nozzles are therefore qualitatively different from one another dependent on those different inlet conditions. Similarly, the shrouds are subject to different inlet conditions and are preferentially designed and located based on those known inlet conditions.

24 Claims, 4 Drawing Sheets

METHODS AND APPARATUS FOR PREFERENTIAL PLACEMENT OF TURBINE NOZZLES AND SHROUDS BASED ON INLET CONDITIONS

BACKGROUND OF THE INVENTION

The present invention relates to gas turbine nozzles and shrouds in the hot gas path of a turbine and which nozzles and shrouds are preferentially located relative to a circumferential array of combustors based on inlet conditions to the nozzles and shrouds, i.e., known circumferential flow characteristics of the hot combustion gases flowing through the nozzle inlet plane and shroud inlet plane.

In conventional gas turbines designed for industrial use, e.g., generation of electrical power, the combustion system is typically comprised of an annular array of circumferentially spaced combustors. Each combustor provides hot gases of combustion through an associated transition piece for flow over a given span of the first-stage nozzles, a given span of first-stage shrouds opposite the first-stage turbine buckets and then through the nozzles and past shrouds of later stages. With respect to the nozzles, each nozzle is comprised of a pair of circumferentially spaced, adjacent nozzle vanes and inner and outer sidewalls defining the flowpath through the nozzle for the hot gases of combustion. In the design of combustors, there are known variations in the circumferential flow characteristics that cause each nozzle to see different inlet conditions. For example, at the first-stage nozzle inlet plane or substantially at the transition piece exit plane, one nozzle may see significantly different heat transfer coefficients and/or temperatures than an adjacent nozzle receiving hot gases of combustion from the same combustor and transition piece. Moreover, one of the nozzles of the set of nozzles which receives the hot gases of combustion from a single combustor may see different flow conditions at different locations along the nozzle inlet. For example, in a gas turbine combustion system having fourteen combustors and forty-two first-stage nozzles, it will be appreciated that the combustor/nozzle clocking arrangement provides three nozzles which receive the hot gases of combustion from one combustor. Because of the variations in flow characteristics, the inlet conditions seen by one of the nozzles are considerably different from the inlet conditions seen by the other two nozzles. More particularly, because of the swirling effects of the flow of fuel within the combustor, a first nozzle of the three nozzles not only may have a higher temperature buildup than the two adjacent nozzles but also a higher temperature at a location along the outer diameter and adjacent an outer corner of the nozzle. The other two nozzles of the set of nozzles receiving hot gases of combustion from the one combustor may have substantially the same inlet temperature uniformly across each nozzle inlet. A hot spot is thus created in a first-stage nozzle of each set thereof associated with each combustor and which hot spot which can vary in temperature as much as 500° F. relative to the remaining nozzles of the set. The different flow characteristics also produce variations in pressure.

Because of those recognized variations in the circumferential flow and temperature characteristics at the inlet plane of nozzles, nozzle components are conventionally uniformly designed to meet the most deleterious combustor conditions. As a consequence, one or more nozzles of each nozzle set will be over-designed, which has a negative effect on engine performance and cost. For example, the first-stage nozzle of an industrial gas turbine is typically air or steam-cooled. By designing all nozzles of a stage the same and for the worst-case scenario, the first nozzle which sees a higher temperature inlet condition than the two adjacent nozzles of the set of nozzles receiving combustion gases from the same combustor may be cooled adequately for that condition. However, the other nozzle(s) of that set will be over-cooled, using valuable compressor discharge air or steam with consequent negative impact on engine performance. Further, nozzles for industrial gas turbines are typically formed in nozzle segments and secured in a circumferential array thereof to form the first and second-stage nozzles. Notwithstanding tight controls on production, each nozzle segment may have a different quality. For example, the welds on the nozzle segments may be different or the magnitude of the thermal barrier coatings may be slightly different. Consequently, the structural characteristics of the segments may have slight variations which may lead to acceptance or non-acceptance of the segments for use in the gas turbine. The structural characteristics of each nozzle segment may therefore be unacceptable for forming a nozzle at a "hot spot" but perfectly acceptable for a nozzle at a different location within the same set which would be subject to less stringent conditions.

The same is true for the shrouds surrounding the buckets for the various turbine stages. Thus, the shrouds of the various stages similarly see the variations in the circumferential flow characteristics along a shroud inlet plane. The shrouds therefore see significantly different heat transfer coefficients and/or temperatures than adjacent shrouds receiving the hot gases of combustion from the upstream nozzle stage. Similarly as the nozzles, the shrouds are conventionally uniformly designed to meet the most deleterious flowpath conditions with the over-designed shrouds having similar negative effects on engine performance and cost as the nozzles as previously described.

Typically, there are the same number of inner shrouds as nozzles. Alternatively, there may be a different number of shrouds than nozzles, for example, two shrouds for each nozzle. In any event, the various shrouds about the hot gas path will see different inlet conditions as described above.

BRIEF SUMMARY OF THE INVENTION

In accordance with a preferred embodiment of the present invention, the nozzles and shrouds of each set of nozzles and shrouds for each associated combustor are preferentially located in accordance with respective nozzle and shroud inlet conditions. For example, and with respect to the nozzles, where hot spots in the inlet conditions to each set of nozzles receiving the hot gases of combustion from an associated combustor are identified, the nozzle at that circumferential location can be designed for that increased temperature condition. Thus, that nozzle may be provided with increased cooling, e.g., increasing the air or steam flow through the nozzle to further cool the nozzle to accommodate the hot spot. Conversely, the remaining nozzle or nozzles of the set of nozzles receiving the combustion gases from the same combustor need not be designed to the worst-case scenario but can be designed, for example, to provide a reduced cooling flow of air or steam. In this manner, over-design of the latter nozzle(s) is avoided. Also, the quality of the nozzles forming a set of nozzles receiving combustion gases from one combustor can be different. For example, the structural quality of the nozzles receiving the cooler flow of the hot gases of combustion need not have the same structural quality of the nozzle of that set which receives the hotter flow from the same combustor. Thus, wall thicknesses or coatings such as thermal barrier coatings, or both, can be reduced for those nozzles identified with the cooler flows of combustion gases as compared with the wall thickness and/or coatings of the nozzle of that set which receives the hotter gases of combustion gases. By preferentially designing the nozzles of each set thereof and locating those nozzles dependent upon the inlet conditions from each combustor, engine performance and total life of the nozzles can be increased. It will be appreciated that the foregoing is applicable to both first and second-stage nozzles.

Similarly as with the case of the nozzles, the shrouds are preferentially located in accordance with conditions of the hot gases flowing along the hot gas path past an inlet plane to the annular array of shrouds of the rotor stages. For example, where hot spots in the inlet conditions to shrouds downstream of the nozzles are identified, the shroud or shrouds at that location can be designed for that increased temperature condition. For example, increased cooling may be supplied. Conversely, the shrouds of the remaining set of shrouds receiving the combustion gases from the same combustor, albeit via the upstream nozzles, need not be designed to the worst-case scenario but can be designed to provide reduced cooling or reduced structural quality. Moreover, thicknesses or coatings can be altered to accommodate the reduced temperature of the gases. Accordingly, the shrouds, similarly as the nozzles, can be preferentially designed dependent upon conditions of the hot gases of combustion flowing past the shrouds for increased engine performance and total life of the shrouds. It will also be appreciated that the foregoing is applicable to the shrouds of each of the turbine stages.

In a preferred embodiment according to the present invention, there is provided for a gas turbine having a circumferential array of components at least in part defining a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of preferentially locating the first component relative to the second component within each set of components at a circumferential location relative to the associated combustor based on the different inlet conditions to the components.

In a further preferred embodiment according to the present invention, there is provided for a gas turbine having a circumferential array of nozzles and a plurality of combustors for flowing hot gases of combustion through respective sets of adjacent nozzles, first and second nozzles of each set of nozzles being subject to different inlet conditions of the hot gases of combustion from an associated combustor, a method of placement of the nozzles and combustors relative to one another, comprising the step of preferentially locating the first nozzle relative to the second nozzle within each set of nozzles at a circumferential location relative to the associated combustor based on the differential inlet conditions to the nozzles.

In a further preferred embodiment according to the present invention, there is provided for a gas turbine having a circumferential array of components defining at least in part a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of increasing turbine performance by preferentially locating the first component relative to the second component within each set of components at a circumferential location relative to the associated combustor based on the different inlet conditions.

In a further preferred embodiment according to the present invention, there is provided for a gas turbine having a circumferential array of components defining at least in part a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of increasing the part life of the components by preferentially locating the first component relative to the second component within each set of components at a circumferential location relative to the associated combustor based on the different inlet conditions.

In a further preferred embodiment according to the present invention, there is provided a gas turbine comprising a circumferential array of components at least in part defining a hot gas path through the turbine, a circumferential array of combustors for flowing hot gases of combustion along the hot gas path through respective sets of adjacent components, first and second components of the sets thereof being subject to different inlet conditions of the hot gases of combustion from respective combustors associated therewith, the first component of each set thereof being located at a circumferential location relative to the second component of each set thereof and the associated combustor based on the different inlet conditions and having a qualitative difference in comparison with the second component.

DETAILED DESCRIPTION OF THE INVENTION

Figure 1:
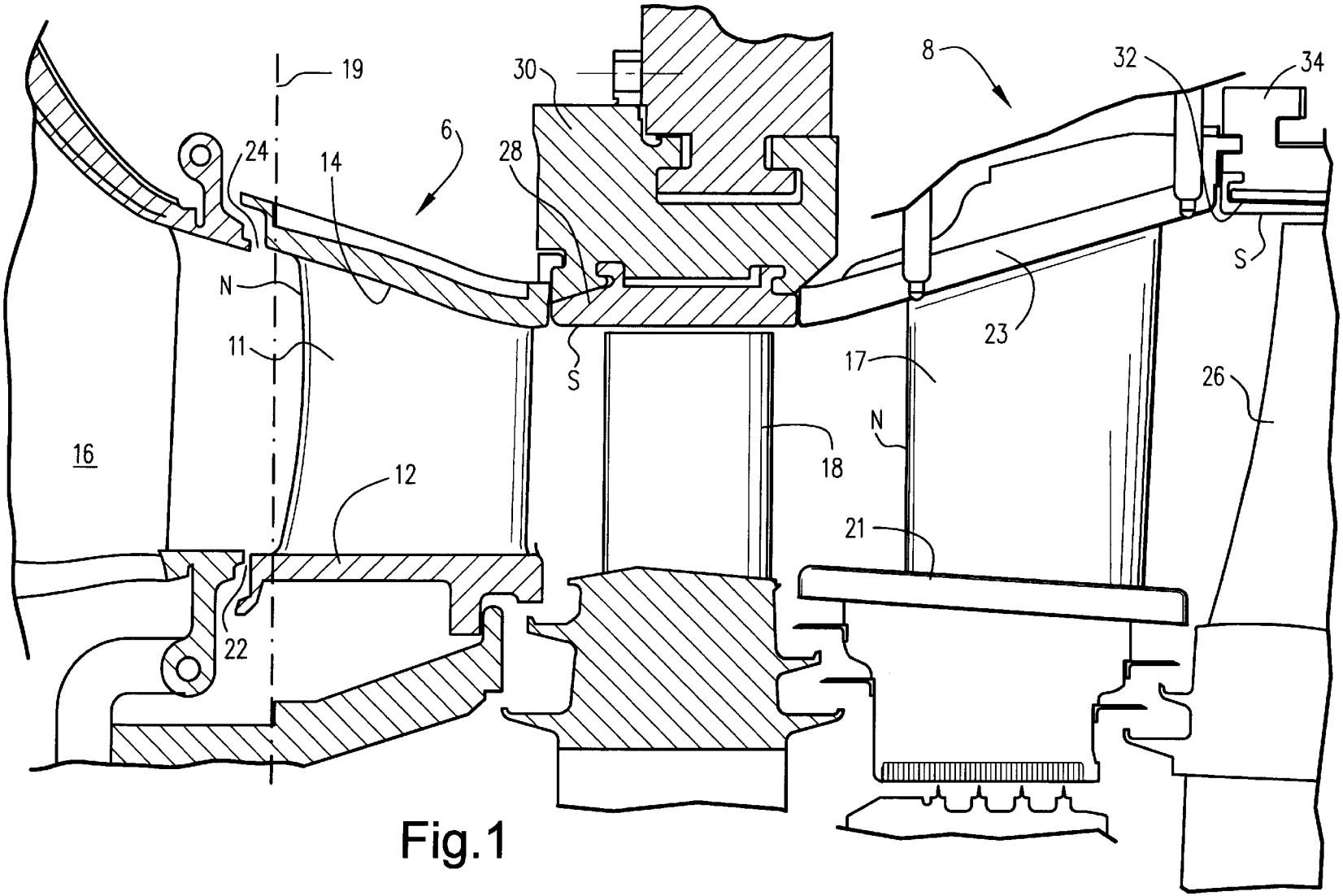
FIG. 1 is a schematic fragmentary view of first and second stages of a turbine illustrating the hot gas path.

Referring now to the drawings, particularly to FIG. 1, there are illustrated first and second stages of nozzles, generally designated 6 and 8, respectively, for a gas turbine. The first-stage nozzle includes a plurality of components, i.e., nozzles N each defined by a pair of adjacent vanes 11 and inner and outer sidewalls 12 and 14, respectively, which define in part the hot gas path through the first-stage nozzle. That is, the hot gases of combustion from combustors 15 (FIGS. 3 and 4) flow axially through transition pieces 16 to the nozzles N of the first stage and particularly between each circumferentially adjacent nozzle vane 11 and the inner and outer sidewalls 12 and 14. The hot gases of combustion passing through the nozzles N along the hot gas path, of course, drive the first-stage turbine buckets 18. The second stage 8 also includes a plurality of nozzles N each defined by a pair of adjacent vanes 17 and inner and outer sidewalls 21 and 23, respectively, defining in part the hot gas path through the second-stage nozzle 8. The second-stage buckets are illustrated at 26.

Also illustrated in FIG. 1 are the inner and outer shrouds of the first and second stages opposite the turbine buckets 18 and 26, respectively. Particularly, the inner and outer shrouds 28 and 30 of the first stage and the inner and outer shrouds 32 and 34 of the second stage are illustrated.

Figure 2:
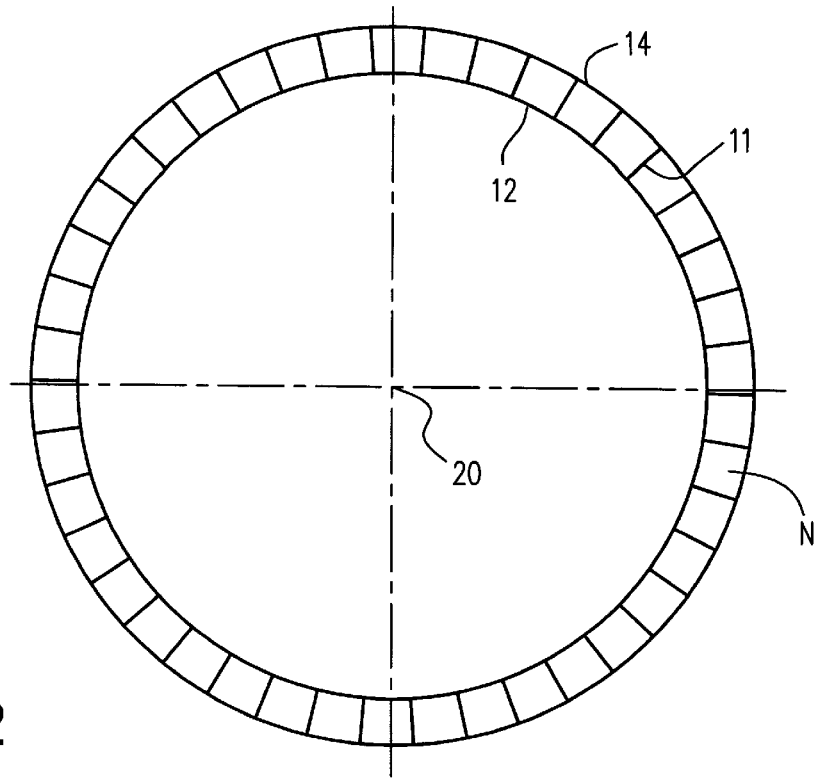
FIG. 2 is a schematic illustration of the clocking of a nozzle stage.
Figure 3:
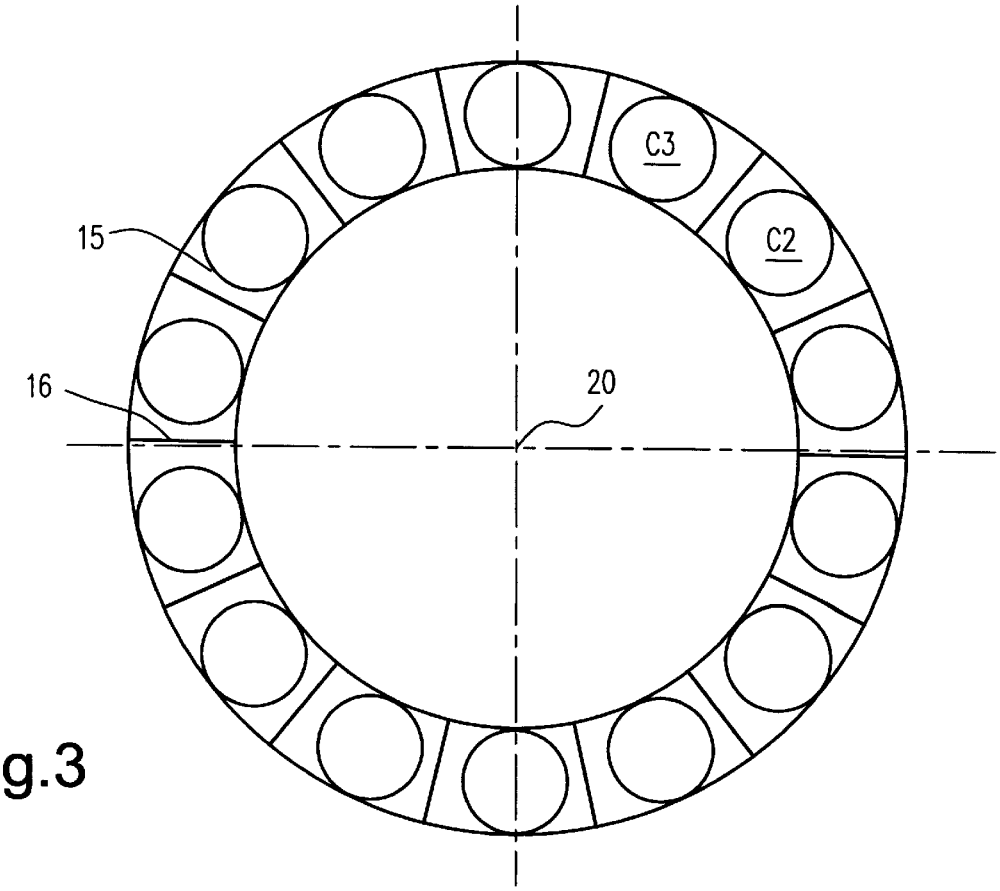
FIG. 3 is a schematic illustration of a combustor nozzle stage clocking.

Referring to FIG. 2 and describing first the preferential location of the first-stage nozzles, the nozzle vanes 11 are arranged in a circumferential array thereof and are clocked around the axis 20 of the turbine. In FIG. 3, it will be appreciated that the plurality of combustors 15 are arranged in a circumferential array thereof about the axis 20 and provide the hot gases of combustion to the nozzles 11 via the transition pieces 16. It will be appreciated that each individual combustor 15 includes a plurality of fuel nozzles, not shown, which provide a swirl to the fuel and hence to the hot gases of combustion flowing from the combustors 15 through the transition pieces 16 into the nozzles. It has been found that this swirling pattern of hot gases of combustion creates a variation in the flow characteristics of the hot gases of combustion from the combustors 15 through the transition pieces 16 into the nozzles N. These variations include temperature and pressure variations along the inlet plane 19 of the nozzles N.

Figure 4:
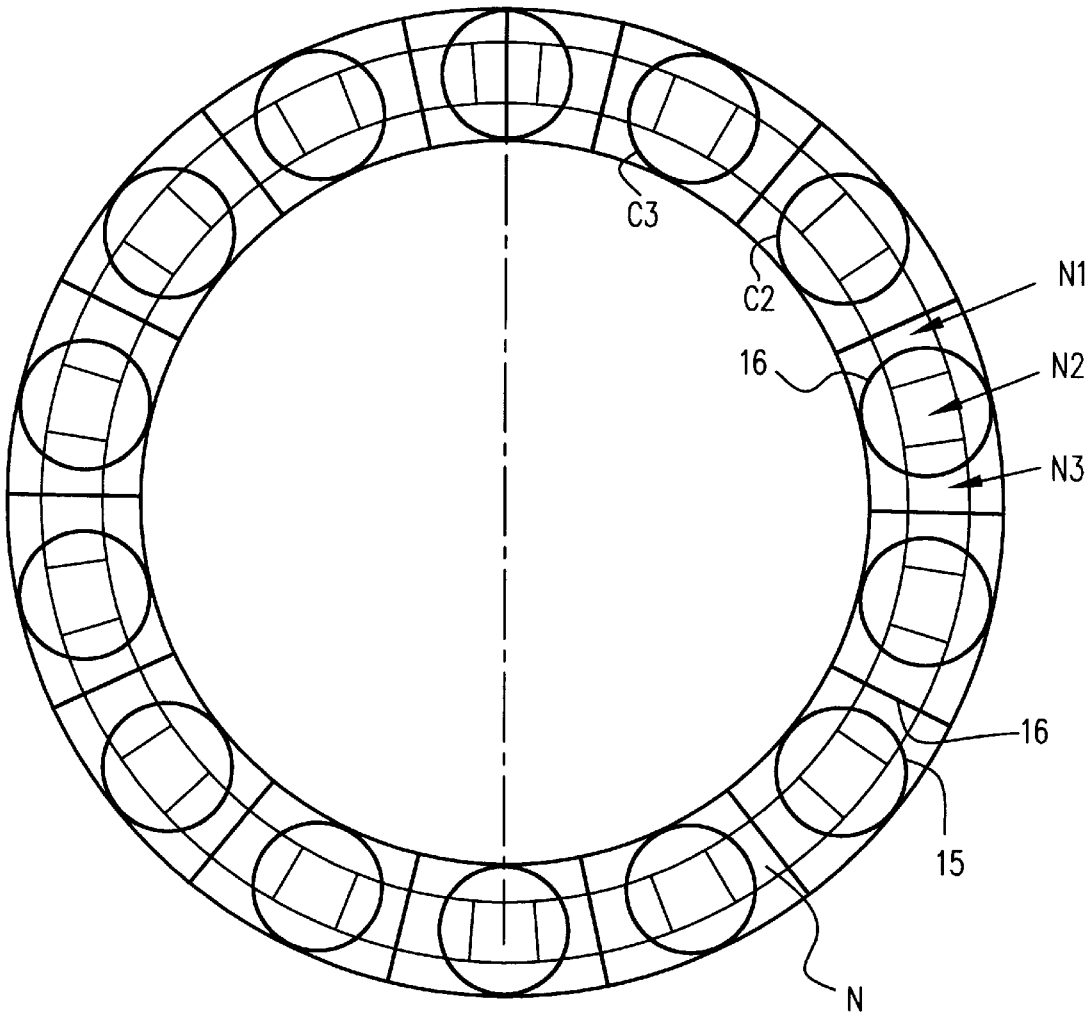
FIG. 4 is a combustor/nozzle clocking composite looking aft from the combustor toward the nozzle inlet of a first-stage nozzle.

Referring now to FIG. 4, there is illustrated a typical combustor/nozzle clocking composite illustrating the arrangement of the combustors 15, transition pieces 16 and nozzles N relative to one another. In FIG. 4, there are specifically illustrated three nozzles N1, N2 and N3, which receive substantially the entirety of the hot gases of combustion from an associated combustor 15 through an associated transition piece 16. While three nozzles are illustrated for each combustor, it will be appreciated that the number of nozzles N per combustor can be different than the ratio of 3:1 and that higher or lower ratios can be provided. The arrangement of three nozzles N to one combustor is therefore exemplary only and is not considered limiting. It will also be appreciated that, while the present description and illustration proceeds with particular reference to the first-stage nozzles, the invention is equally applicable to the second-stage nozzles. The second-stage nozzles are clocked about the rotor axis relative to the combustors for similar reasons as discussed herein, the nozzles by definition also including the inner and outer sidewalls.

As previously noted, the flow characteristics of the hot gases of combustion from each combustor 15 through its associated transition piece 16 into associated nozzles N1, N2 and N3 are different. For example, the temperature characteristics of the hot gases of combustion entering nozzle N1, particularly along its outer diameter, has been identified, for example, by computer-modeling, as hotter than the gases passing through the remaining portion of nozzle N1 and through nozzles N2 and N3. Such temperature variation can be as much as 500° F. It will be appreciated, therefore, that purge air flowing into the hot gas path through the gaps 22 and 24 (FIG. 1) between the transition piece 16 and the shrouds 12 and 14, respectively, for example, must accommodate the increase in temperature of the gases flowing through nozzle N1 in comparison with the temperature of the gases flowing through nozzles N2 and N3. Moreover, the cooling flows of air or steam through the nozzles may also be adjusted to accommodate this hotter temperature. For a representative example of a first-stage nozzle with a cooling medium flowing therethrough, see U.S. Pat. No. 6,079,943, the disclosure of which is incorporated by reference. The quality of the nozzle N1 must likewise accommodate this variation in temperature. As noted previously, nozzles were previously designed to uniform standards to meet the worst-case scenario. Consequently, the nozzles N2 and N3 are over-designed from quality and cooling standpoints relative to nozzle N1. By quality is meant the thickness of the walls of the parts forming the nozzle, the soundness of the welds and/or, in general, the anticipated life or robustness of the parts.

In accordance with the present invention, the nozzles N can be preferentially placed in the annular array thereof in accordance with the inlet conditions seen by each nozzle relative to its associated combustor, and transition piece. For example, the nozzle N1 which sees inlet conditions of higher temperatures than the temperatures seen by nozzles N2 and N3 may have increased cooling in comparison with the cooling afforded nozzles N2 and N3. The purge air provided through slots 22 and 24 may be increased. Conversely, nozzles N2 and N3 require decreased cooling flow, e.g., temperature in comparison with the cooling flow or temperature of nozzle N1. Consequently, increased engine performance may be achieved by reducing the cooling required for the nozzles N2 and N3 from that otherwise necessary should all nozzles be designed identically for the worst-case scenario, i.e., to accommodate the hotter temperature of the flow of combustion gases through nozzle N1. Moreover, the quality of the nozzles which are exposed to the lower temperatures of the associated combustor, i.e., nozzles N2 and N3, may be reduced. By a quality reduction is meant that the nozzles N2 and N3 may have reduced structural requirements and/or reduced coatings in comparison with those structural and coating requirements necessary for nozzle N1 to accommodate the higher temperature portions of the combustion gases. For example, the nozzle segments, i.e., the outer and inner walls 12 and 14 and each vane or vanes forming a nozzle segment, are manufactured within certain tolerances. Due to variations in manufacture of the segments within those tolerances, segments which are more robust than others can be identified and preferentially located, i.e., clocked vis-a-vis the combustors to accommodate the known variations in nozzle inlet flow. Because of the known substantial disparity in inlet flow conditions to the nozzles, certain nozzles may be manufactured with a structural robustness, e.g., material sizes may be increased, and located to accommodate the more adverse conditions while remaining nozzles may be manufactured with less structural robustness and located to accommodate the less deleterious inlet conditions. Similarly, different thermal barrier coatings (TBC), e.g., thickness or materials may be provided nozzles N dependent upon their location within the stage nozzle. Also, different cooling requirements and the structure to accommodate these different cooling requirements may be provided the various nozzles dependent upon their intended location along the stage nozzle. For example, reduced cooling flow may be provided those nozzles located in portions vis-a-vis the associated combustors and transition pieces known to have less thermal loading (be it flow induced heat transfer coefficient increase or a function of temperature profile circumferentially). Consequently, each nozzle may have structural or cooling requirements different from other nozzles of the stage and are thus preferentially located within the nozzle stages dependent upon the various known inlet conditions about the nozzle stage.

Figure 5:
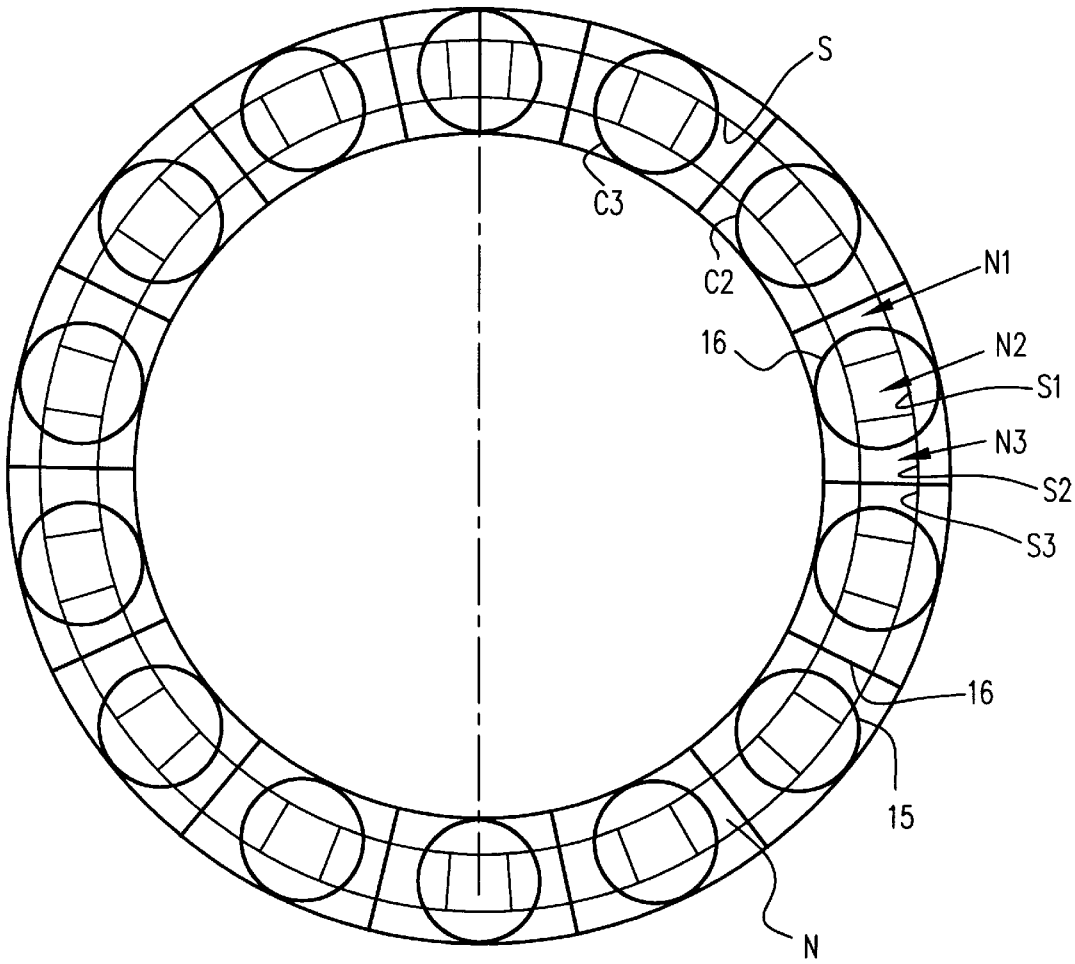
FIG. 5 is a view similar to FIG. 4 illustrating a clocking composite of the shrouds, nozzles and combustors relative to one another.

The foregoing description as applied to the nozzles is also applicable to other turbine components, e.g., shrouds of the first and other stages of the turbine. The swirling pattern of the hot gases of combustion from the combustors as the hot gases flow through the nozzles also create variations in the flow characteristics of those hot gases along the shrouds arrayed about the buckets of the turbine stages, e.g., shrouds 28 and 32. Assuming, for example, that there is an inner shroud downstream of each nozzle of an associated stage, it will be appreciated that the flow pattern has similar variations as at the inlet to the associated nozzles. For example, and referring to FIG. 5, temperature characteristics of the flow received from nozzle N1 by shroud S1, will be hotter than the gases received by shrouds 52 and 53 from nozzles N2 and N3. While the shroud or shrouds receiving the hottest gases from the nozzles may be at a different circumferential locations than the nozzle N1 receiving the hottest gases, the effect will be similar. Therefore, the shroud S1 receiving the hottest gases may be designed differently than the shrouds 52 and 53 receiving the cooler gases. Additional cooling may be provided or coatings of different quality or thickness may be provided the shrouds. The shrouds may be more structurally robust than the adjacent shrouds which receive the cooler gases. As a consequence, the shrouds of the various stages may be preferentially located relative to one another about the turbine axis based on different conditions of the hot gases flowing into an inlet plane of the shrouds.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For a gas turbine having a circumferential array of components at least in part defining a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of:

preferentially locating the first component relative to the second component within each set of components at a circumferential location relative to the associated combustor based on the different inlet conditions to the components.

2. A method according to claim 1 including assessing the quality of the first and second components, and providing the first component within each set thereof of a higher quality than the quality of the second component.

3. A method according to claim 1 wherein said components include shrouds.

4. For a gas turbine having a circumferential array of nozzles and a plurality of combustors for flowing hot gases of combustion through respective sets of adjacent nozzles, first and second nozzles of each set of nozzles being subject to different inlet conditions of the hot gases of combustion from an associated combustor, a method of placement of the nozzles and combustors relative to one another, comprising the step of:

preferentially locating the first nozzle relative to the second nozzle within each set of nozzles at a circumferential location relative to the associated combustor based on the differential inlet conditions to the nozzles.

5. A method according to claim 4 including providing the first nozzle within each set thereof with increased cooling capacity relative to said second nozzle.

6. A method according to claim 4 including providing the second nozzle within each set thereof with decreased cooling capacity relative to said first nozzle.

7. A method according to claim 4 including assessing the quality of the first and second nozzles, and providing the first nozzle within each set thereof of a higher quality than the quality of the second nozzle.

8. A method according to claim 7 wherein the step of assessing the quality of the first and second nozzles includes assessing the structural quality thereof.

9. A method according to claim 4 including assessing the quality of the first and second nozzles, providing the second nozzle within each set thereof of a lower quality than the quality of the first nozzle.

10. A method according to claim 9 wherein the step of assessing the quality of the first and second nozzles includes assessing the structural quality thereof.

11. A method according to claim 4 wherein the nozzles form part of a first stage of the turbine.

12. A method according to claim 4 wherein the nozzles form part of a second stage of the turbine.

13. For a gas turbine having a circumferential array of components defining at least in part a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of:

increasing turbine performance by preferentially locating the first component relative to the second component within each set of components at a circumferential location relative to the associated combustor based on the different inlet conditions.

14. A method according to claim 13 wherein said components include nozzles.

15. A method according to claim 13 wherein said components include shrouds.

16. For a gas turbine having a circumferential array of components defining at least in part a hot gas path through the turbine and a plurality of combustors for flowing hot gases of combustion through respective sets of components, first and second components of each set of components being subject to different inlet conditions of the hot gases of combustion from an associated combustor, a method of placement of the components and combustors relative to one another, comprising the step of:

increasing the part life of the components by preferentially locating the first component relative to the second component within each set of components at a circumferential location relative to the associated combustor based on the different inlet conditions.

17. A method according to claim 16 wherein said components include nozzles.

18. A method according to claim 16 wherein said components include shrouds.

19. A gas turbine comprising:

a circumferential array of components at least in part defining a hot gas path through the turbine;

a circumferential array of combustors for flowing hot gases of combustion along the hot gas path through respective sets of adjacent components, first and second components of said sets thereof being subject to different inlet conditions of the hot gases of combustion from respective combustors associated therewith;

said first component of each set thereof being located at a circumferential location relative to the second component of each set thereof and the associated combustor based on the different inlet conditions and having a qualitative difference in comparison with said second component.

20. A turbine according to claim 19 wherein each said first component has increased cooling capacity relative to said second component.

21. A turbine according to claim 19 wherein each said second component has decreased cooling capacity relative to said first component.

22. A turbine according to claim 19 wherein said first component is structurally different than said second component.

23. A turbine according to claim 19 wherein said components comprise shrouds.

24. A turbine according to claim 19 wherein said components comprise nozzles.

* * * * *

UNITED STATES PATENT AND TRADEMARK OFFICE

CERTIFICATE OF CORRECTION

PATENT NO. : 6,572,330 B2
APPLICATION NO. : 09/820291
DATED : June 3, 2003
INVENTOR(S) : Burdgick It is certified that error appears in the above-identified patent and that said Letters Patent is hereby corrected as shown below:

Column 1, line 5, below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*